US009929470B2

(12) United States Patent
Grando et al.

(10) Patent No.: US 9,929,470 B2
(45) Date of Patent: Mar. 27, 2018

(54) LOW PROFILE WIDEBAND PLANAR ANTENNA ELEMENT WITH INTEGRATED BALUNS

(71) Applicant: L-3 Communications Corporation, New York, NY (US)

(72) Inventors: Maurio Batista Grando, McKinney, TX (US); George Zohn Hutcheson, Richardson, TX (US)

(73) Assignee: L-3 Communications Corporation, New York, NY (US)

( * ) Notice: Subject to any disclaimer, the term of this patent is extended or adjusted under 35 U.S.C. 154(b) by 28 days.

(21) Appl. No.: 15/143,442

(22) Filed: Apr. 29, 2016

(65) Prior Publication Data

US 2017/0317422 A1 Nov. 2, 2017

(51) Int. Cl.

| | |
|---|---|
| ***H01Q 21/26*** | (2006.01) |
| ***H01Q 9/28*** | (2006.01) |
| ***H01Q 1/50*** | (2006.01) |
| ***H01P 5/10*** | (2006.01) |

(52) U.S. Cl.

CPC ..... *H01Q 9/285* (2013.01); *H01P 5/10* (2013.01); *H01Q 1/50* (2013.01)

(58) Field of Classification Search

CPC ..... H01Q 1/007; H01Q 1/38; H01Q 21/26; H01Q 21/30; H01Q 9/16; H01Q 9/28

See application file for complete search history.

(56) References Cited

U.S. PATENT DOCUMENTS

| | | | | |
|---|---|---|---|---|
| 4,924,236 A * | 5/1990 | Schuss | ..... | H01Q 9/0442 343/700 MS |
| 5,146,234 A * | 9/1992 | Lalezari | ..... | H01Q 1/36 343/859 |
| 5,532,708 A * | 7/1996 | Krenz | ..... | H01Q 9/40 343/795 |

(Continued)

FOREIGN PATENT DOCUMENTS

KR 101213188 B1 * 12/2012

OTHER PUBLICATIONS

Best et al., "Design of a Broadband Dipole in Close Proximity to an EBG Ground Plane", IEEE Antenna and Propagation, vol. 50, No. 6, Dec. 2008, pp. 52-64.

(Continued)

*Primary Examiner* — Tho G Phan

(74) *Attorney, Agent, or Firm* — Egan Peterman Enders Huston

(57) ABSTRACT

An antenna assembly for use in a tile architecture antenna system. The antenna assembly comprises: i) a first substrate layer having a first surface; ii) a first antenna disposed in an X-Y plane on the first surface of the first substrate layer; iii) a second substrate layer having a first surface, the second substrate layer displaced in the Z-direction with respect to the X-Y plane on the first surface of the first substrate layer; and iv) a first tuning balun disposed on the first surface of the second substrate layer and coupled to the first antenna by means of a first feed via. The antenna assembly further comprises a first transmission line disposed on the first surface of the second substrate layer. The first transmission line is coupled to the first antenna by means of a second feed via.

20 Claims, 8 Drawing Sheets

(56) References Cited

U.S. PATENT DOCUMENTS

| | | | | |
|---|---|---|---|---|
| 5,657,030 | A * | 8/1997 | Peck | H01Q 11/06 343/733 |
| 2009/0295667 | A1* | 12/2009 | Ma | H01Q 1/2225 343/795 |
| 2014/0097995 | A1 | 4/2014 | McKinzie | |
| 2015/0263426 | A1 | 9/2015 | Hsu et al. | |
| 2016/0156109 | A1* | 6/2016 | Anderson | H01Q 21/0093 343/852 |

OTHER PUBLICATIONS

Yang et al., "Reflection Phase Characterizations of the EBG Ground Plane for Low Profile Wire Antenna Applications", IEEE Transactions on Antennas and Propagation, vol. 51, No. 10, Oct. 2003, pp. 2691-2703.

Akhoondzadeh-Asl et al., Wideband Dipoles on Electromagnetic Bandgap Ground Planes, 2005, 6 pgs.

McMichael et al., "A Method for Determining Optimal EBG Reflection Phase for Low Profile Dipole Antennas", IEEE Transactions on Antennas and Propagation, vol. 61, No. 5, May 2013, pp. 2411-2417.

Azad et al., "Novel Wideband Directional Dipole Antenna on a Mushroom Like EBG Structure", IEEE Transactions on Antennas and Propagation, vol. 56, No. 5, May 2008, pp. 1242-1250.

Engheta et al., "Metamaterial Physics and Engineering Explorations", Chapter 11, IEEE, 2006, pp. 287-311.

Grando et al., "Low Profile Wideband Planar Antenna Element", U.S. Appl. No. 15/143,421, filed Apr. 29, 2016, 22 pgs.

Akhoondzadeh-Asl et al., "Wideband Dipoles on Electromagnetic Bandgap Ground Planes", IEEE Transactions on Antennas and Propagation, vol. 55, No. 9, Sep. 2007, pp. 2426-2434.

* cited by examiner

300

LOW PROFILE WIDEBAND PLANAR ANTENNA ELEMENT WITH INTEGRATED BALUNS

CROSS-REFERENCE TO RELATED APPLICATION

The present application is related to U.S. patent application Ser. No. 15/143,421 entitled "Low Profile Wideband Planar Antenna Element" filed concurrently herewith. Application Ser. No. 15/143,421 is assigned to the assignee of the present application and is hereby incorporated by reference into the present application as if fully set forth herein.

TECHNICAL FIELD

The present application relates generally to antennas and, more specifically, to a wideband bowtie planar antenna element with integrated baluns.

BACKGROUND

Current advanced radar systems favor highly integrated designs in order to reduce cost and to aid in the manufacturability of complex systems. As a result, tile architecture antenna designs are highly desirable implementations. However, one drawback to tile architecture antenna designs is the bandwidth of such antennas. Another drawback is that driving a tile architecture antenna with a differential signal from an integrated circuit (IC) requires a single-ended to double-ended balun. Most antennas in tile architectures require a considerable height or length in the "Z" direction to provide the required bandwidth. This inherently limits the integration of a tile architecture antenna design into multiple components: 1) the antenna, 2) the balun, and 3) the electronics.

Low profile wideband antennas are commonly desired for conformal and highly integrated antenna designs. Most wideband antennas (e.g., notch antenna, Vivaldi antenna) require some amount of height in the Z-direction in order to provide the necessary bandwidth. So called "bowtie" antennas are also able to provide a large amount of bandwidth and may require less height in the Z-direction. But, in order to be used in a practical array, these bowtie antennas require a ground plane in order to direct radiation in one hemisphere. This requires that the bowtie antenna be a quarter wavelength ($\lambda/4$) from the ground plane. This requirement severely limits the bandwidth.

There are limited options for planar antenna designs with wide bandwidth that can be fabricated with a simple printed circuit board (PCB) process. One solution that is not planar and involves an extended fabrication process is the vivaldi "egg crate" array. However, this requires a complex interface to the radio frequency (RF) electronics to sum array elements in cross dimensions or to add dual polarization capability. Also, the required height in the Z-direction to obtain broadband performance prevents a low profile solution necessary for many applications. Implementations like the vivaldi with antenna designs that require card like interfaces are difficult to integrate and fabricate. At some point, the antenna design must transition to a planar substrate and this complicates integration by requiring the manufacturing process to join two or more physically separated sections.

If the antenna were itself planar and made using traditional PCB manufacturing processes, this would allow for a highly integrated design that is simple to fabricate and manufacture. Prior art publications have disclosed that placing a bowtie antenna over an electromagnetic band gap (EBG) material allows for the bowtie antenna to keep its impedance bandwidth while preserving the pattern performance in that band. But, while the EBG material satisfies the Z (height) condition, the additional requirement of needing a balun adds complications to the design. Baluns proposed in conventional designs require micro-strip Wilkinson designs or twin lead transmission lines along the Z-direction of the substrate.

Also, given a tightly packed array, a planar solution for a balun is not always possible. Currently, the industry solution is to develop a planar balun and then orient the balun perpendicular to the dipole in order to feed it. However, this creates considerable mechanical issues and may cause reliability and repeatability issues. PCB-mounted differential antennas need an integrated balun that conforms to current PCB processes and leaves a small footprint in order to allow for maximum area to accommodate multiple traces and components.

Therefore, there is a need in the art for an improved antenna designs. In particular, there is a need for improved planar antenna systems that may be implemented using an antenna tile architecture.

SUMMARY

To address the above-discussed deficiencies of the prior art, it is a primary object to provide, for use in a tile architecture antenna system, an antenna assembly comprising: i) a first substrate layer having a first surface; ii) a first antenna disposed in an X-Y plane on the first surface of the first substrate layer; iii) a second substrate layer having a first surface, the second substrate layer displaced in the Z-direction with respect to the X-Y plane on the first surface of the first substrate layer; and iv) a first tuning balun disposed on the first surface of the second substrate layer and coupled to the first antenna by means of a first feed via.

In one embodiment, the antenna assembly further comprises a first transmission line disposed on the first surface of the second substrate layer.

In another embodiment, the first transmission line is coupled to the first antenna by means of a second feed via.

In still another embodiment, the antenna assembly further comprises: i) a second antenna disposed in the X-Y plane on the first surface of the first substrate layer; ii) a third substrate layer having a first surface, the third substrate layer displaced in the Z-direction with respect to the X-Y plane on the first surface of the first substrate layer; and iii) a second tuning balun disposed on the first surface of the third substrate layer and coupled to the second antenna by means of a third feed via.

In yet another embodiment, the antenna assembly further comprises a second transmission line disposed on the first surface of the third substrate layer.

In a further embodiment, the second transmission line is coupled to the second antenna by means of a fourth feed via.

In a still further embodiment, the first antenna comprises a first dipole antenna.

In a yet further embodiment, the second antenna comprises a second dipole antenna.

In another embodiment, the first and second antennas comprise a crossed bowtie antenna configuration.

In one embodiment, the antenna assembly further comprises a transceiver circuit disposed on a surface of the antenna assembly opposite the first substrate layer, wherein the transceiver circuit provides an output signal to be transmitted by the first and second antennas.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the embodiments used to describe the principles of the present disclosure are by way of illustration only and should not be construed in any way to limit the scope of the disclosure. Those skilled in the art will understand that the principles of the present disclosure may be implemented in any suitably arranged antenna element.

The present disclosure describes a low profile wideband planar antenna element that may be produced using standard printed circuit board (PCB) etching techniques. Beneficially, this enables the antenna element to be implemented in highly integrated systems in which the antenna element may be part of the radio frequency (RF) stackup layers of the PCB. In the disclosed embodiment, the planar element provides a solution lending itself to highly integrated arrays and communication systems. Similar to a patch, but with far more bandwidth, the disclosed antenna elements may be part of the integrated RF stackup layers and perhaps even the digital stackup layers of the PCB.

Figure 1:
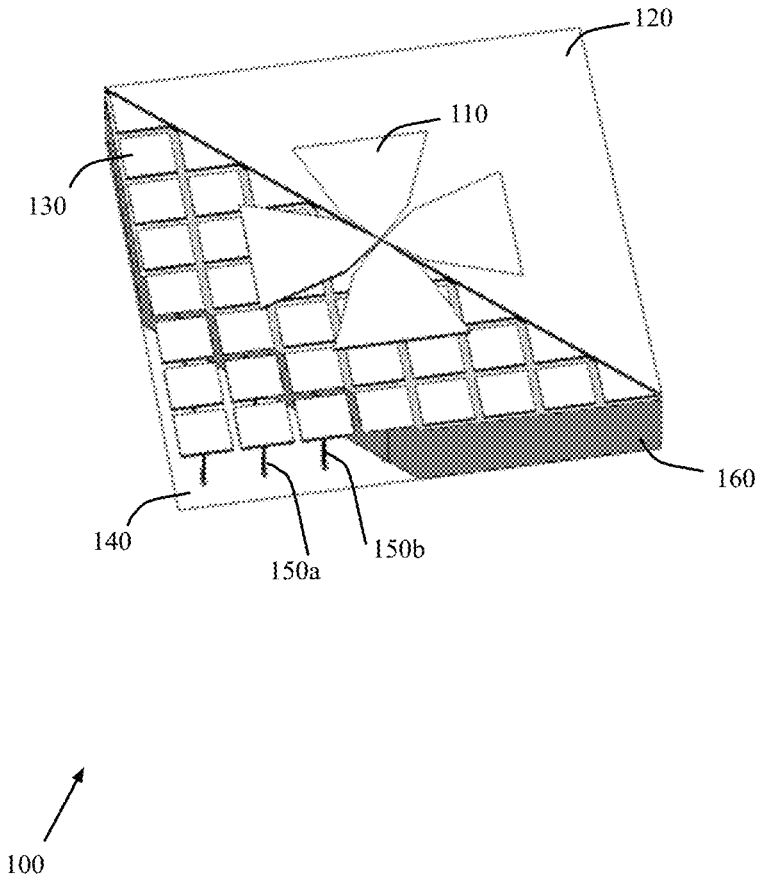
FIG. 1 illustrates a perspective view of a planar antenna using a dual-polarized, multi-function array structure with a differential output according to one embodiment of the disclosure.

FIG. 1 illustrates a perspective (cutaway) view of planar antenna assembly 100 using a dual-polarized, multi-function array structure with a differential output according to one embodiment of the disclosure. Planar antenna assembly 100 comprises antenna 110, thin substrate layer 120, a plurality of electromagnetic band gap (EBG) patches 130, ground plane layer 140, a plurality of electromagnetic band gap (EBG) vias 150, and thick substrate layer 160. Antenna 110 may comprise, by way of example, a crossed bowtie antenna (i.e., two dipole antennas) or a single dipole antenna formed on a first metal layer (Layer 1). In one implementation, such as a radar system, a plurality of antenna assemblies such as planar antenna assembly 100 may be arranged in rows and columns to form an antenna system having a tile architecture.

In an exemplary embodiment, thin substrate layer 120 may be approximately 5 mil (0.005 inches) in thickness and may be formed from a material such as FR4 glass epoxy (e.g., a composite material comprising woven fiberglass cloth with an epoxy resin binder). Also, by way of example, thin substrate layer 120 may be formed from Rogers Corp. RT/duroid 5880 high frequency laminate. In an exemplary embodiment, thick substrate layer 160 may be approximately 30 mil (0.030 inches) or greater in thickness and also may be formed from FR4 glass epoxy or Rogers 5880 laminate. In the cutaway view in FIG. 1, thin substrate layer 120 and thick substrate layer 160 are both shown partially removed in order to illustrate a plurality of rectangular EBG patches, such as EBG patch 130, formed in a second metal layer (Layer 2) and EBG vias 150*a* and 150*b* in the second and third layers.

Figure 2:
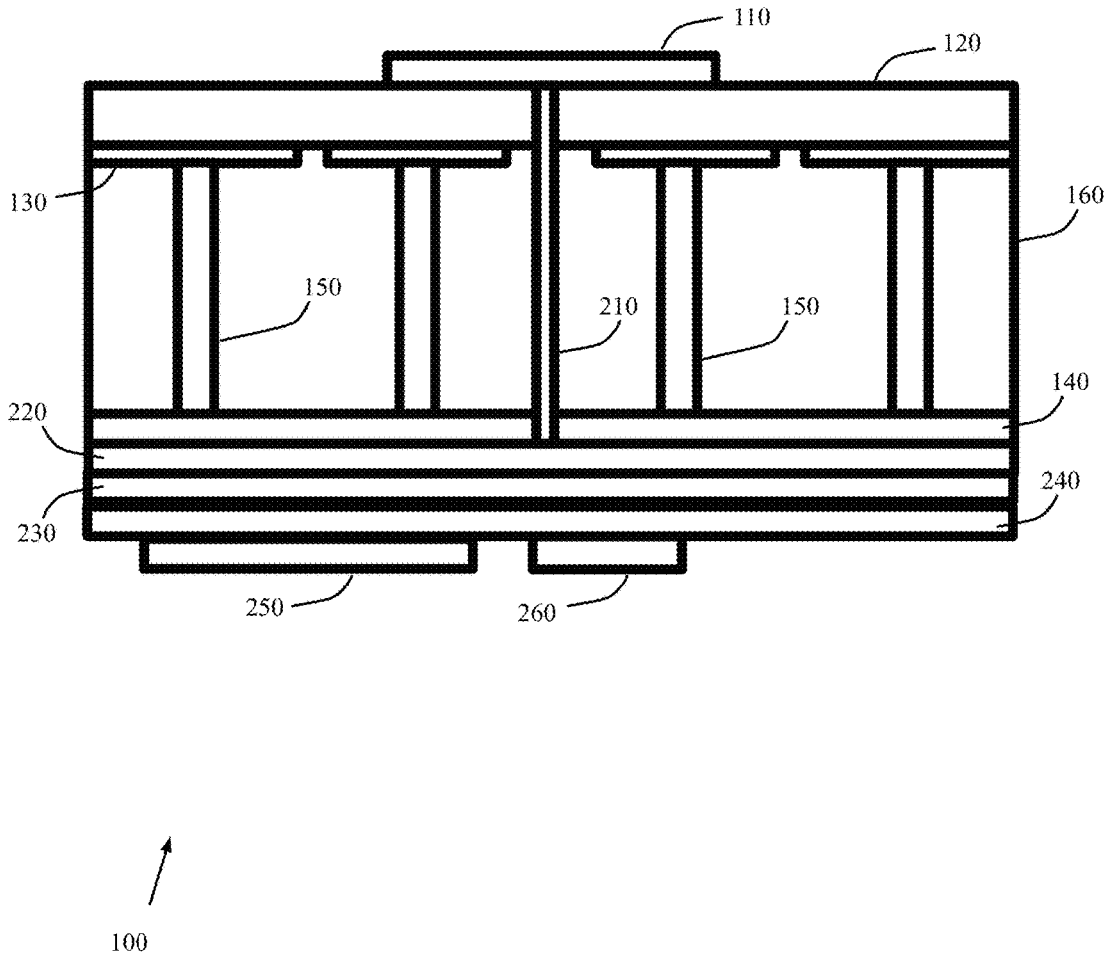
FIG. 2 illustrates a side cross-sectional view of an integrated antenna stackup according to one embodiment of the disclosure.

FIG. 2 illustrates a side view of planar antenna assembly 100 according to one embodiment of the disclosure. As FIG. 2 indicates, planar antenna assembly 100 comprises an integrated antenna stackup. In addition to the components already illustrated and described in FIG. 1, antenna assembly 100 further comprises feed via 210, radio frequency (RF) stack up layers 220, 230, and 240, RF circuit 250, and digital circuit 260. By way of example, one or more of RF stack up layers 220, 230, and 240 may comprise micro-strip line Marchand baluns that provide polarization and/or provide transformation from single-ended transmission lines to differential transmission lines. One or both of RF circuit 250 and digital circuit 260 comprise transceiver circuitry configured to generate an output signal to be transmitted by antenna 100 and/or to receive from antenna 100 an incoming RF signal. In some embodiments of the disclosure, a differential transmission line may be used to couple feed via 210 to the transceiver circuitry.

Feed via 210 provides a signal connection from RF stack up layers 220, 230, and 240, RF circuit 250, and digital circuit 260 to antenna 110 through ground plane 140, thick substrate 160, and thin substrate 120. Each of the plurality of EBG vias 150 provides a connection between ground plane 140 and one of the plurality of EBG patches 130. Advantageously, the multilayer nature of planar antenna assembly 100 provides an efficient, reduced-size tile structure for transmitting signals between antenna 110 and RF circuit 250 and digital circuit 260.

Figure 3:
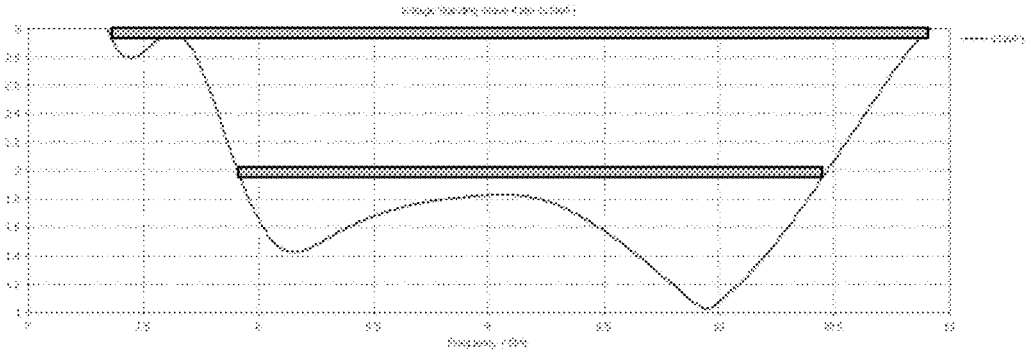
FIG. 3 is a graph of a voltage standing wave ratio (VSWR) of a tile antenna limited by balun bandwidth according to one embodiment of the disclosure.

FIG. 3 is a graph of the voltage standing wave ratio (VSWR) 300 of a tile antenna (as shown in FIGS. 1 and 2) limited by balun bandwidth according to one embodiment of the disclosure. The exemplary frequency range is from 7 GHz to 11 GHz. The VSWR range is from 1 to 3.

Figure 4A:
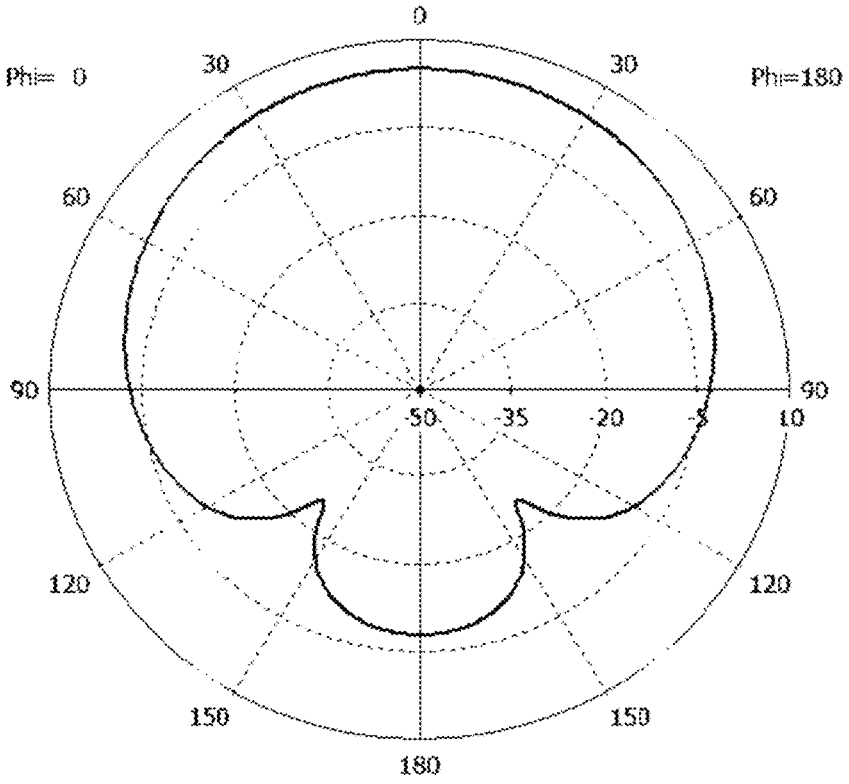
FIGS. 4A-4C illustrate the pattern performance of an integrated crossed bowtie antenna element at various frequencies according to exemplary embodiments of the disclosure.
Figure 4B:
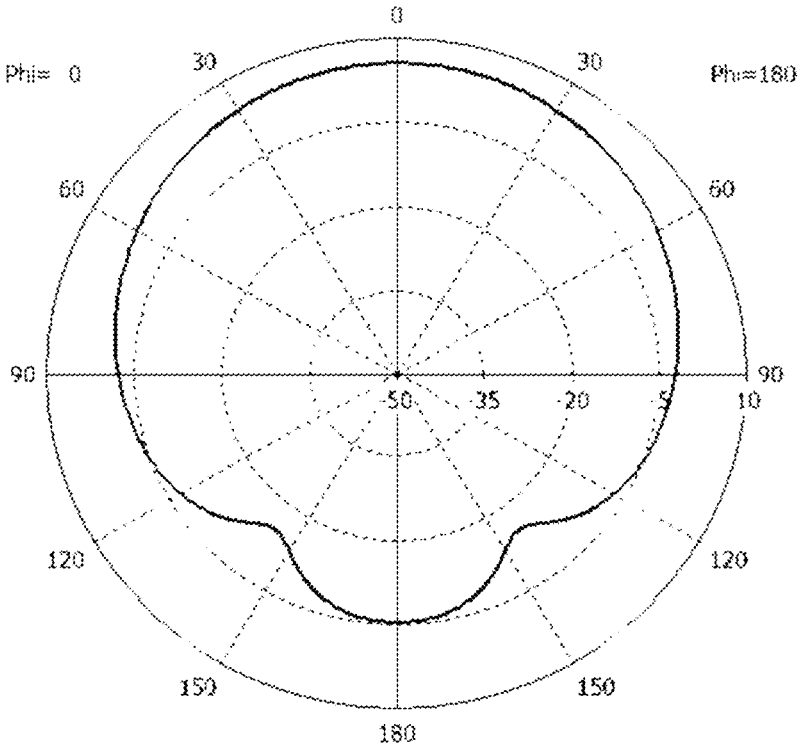
Figure 4C:
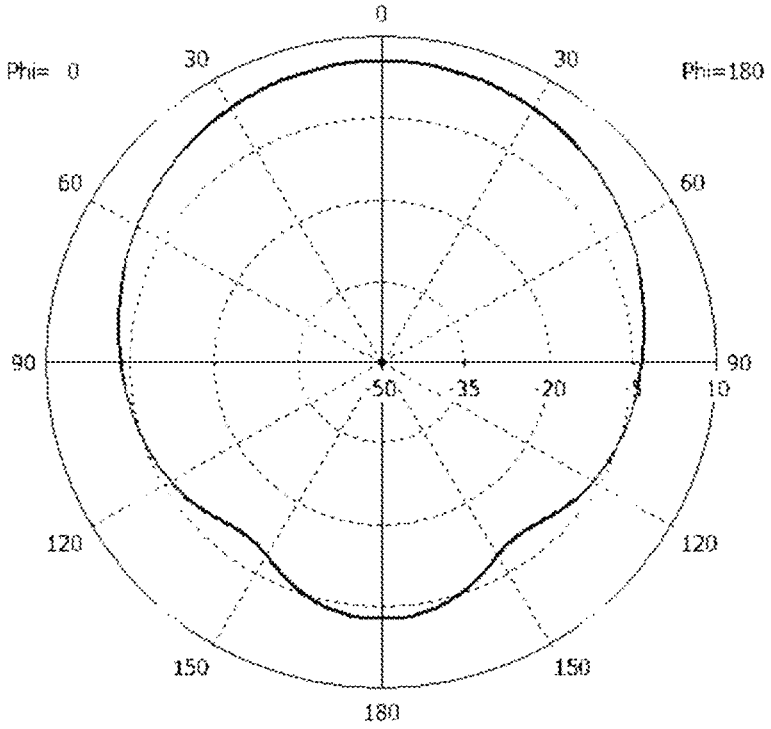

FIGS. 4A-4C illustrate the pattern performance of an integrated crossed bowtie antenna element at various frequencies according to exemplary embodiments of the disclosure. FIG. 4A illustrates the pattern for a crossed bowtie antenna at 8.5 GHz. FIG. 4B illustrates the pattern for a crossed bowtie antenna at 10.0 GHz. FIG. 4C illustrates the pattern for a crossed bowtie antenna at 11.5 GHz.

Figure 5:
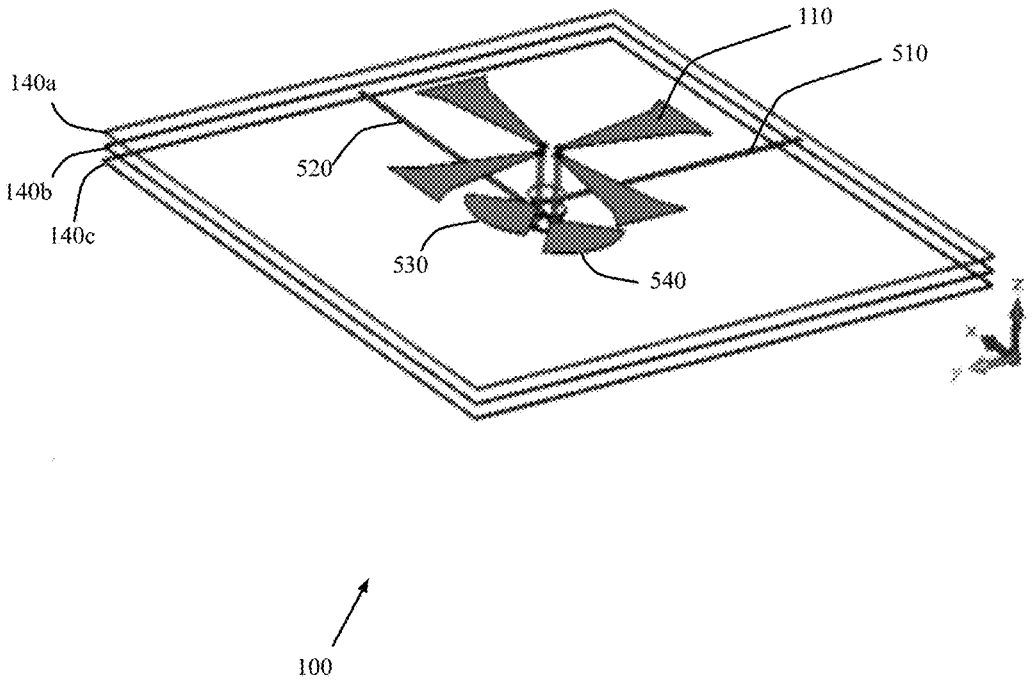
FIG. 5 illustrates an alternate perspective view of a planar antenna assembly using dual polarized antennas with two baluns according to one embodiment of the disclosure.

FIG. 5 illustrates an alternate perspective view of planar antenna assembly 100 using dual polarized antennas with two three dimensional (3D) tuning baluns according to one embodiment of the disclosure. In FIG. 5, much of the multilayer structure in FIGS. 1 and 2 are removed in order to more clearly illustrate the relevant parts of planar antenna assembly 100. Planar antenna assembly 100 comprises a plurality of ground plane layers, each of which may be associated with one of the multiple layers of planar antenna assembly 100. By way of example, each of exemplary ground plane layers 140*a*, 140*b*, and 140*c* may be associated with one of exemplary RF stack up layers 220, 230, and 240. Planar antenna assembly 100 further comprises two dipole antennas 110*a* and 110*b* in a crossed bowtie antenna arrangement, baluns 530 and 540, and transmission lines 510 and 520.

In FIG. 5, antennas 110*a* and 110*b* are fabricated in the X-Y plane on the top layer (i.e., thin substrate layer 120) of planar antenna assembly 100. Baluns 530 and 540 and transmission lines 510 and 520 are fabricated on other layers of planar antenna assembly 100 separate from the layer on which antennas 110*a* and 110*b* are fabricated. By way of example, balun 530 and transmission line 510 may be fabricated on RF stack up layer 220 and balun 540 and transmission line 520 may be fabricated on RF stack up layer 230. In this design, baluns 530 and 540 and transmission lines 510 and 520 are advantageously displaced in the Z-direction with respect to dipole antennas 110*a* and 110*b*.

Transmission line 510 and balun 530 are coupled to antenna 110*a* by means of a feed via similar to feed via 210 in FIG. 2. Similarly, transmission line 520 and balun 540 are coupled to antenna 110*b* by means of a feed via similar to feed via 210. The design is a dual-pole, multi-function array structure with a differential output. Thus, this design allows for multiple polarizations to be achieved and permits the feed transmission lines 510 and 520 to be fabricated on PCB layers that are desired for a given RF implementation.

Figure 6:
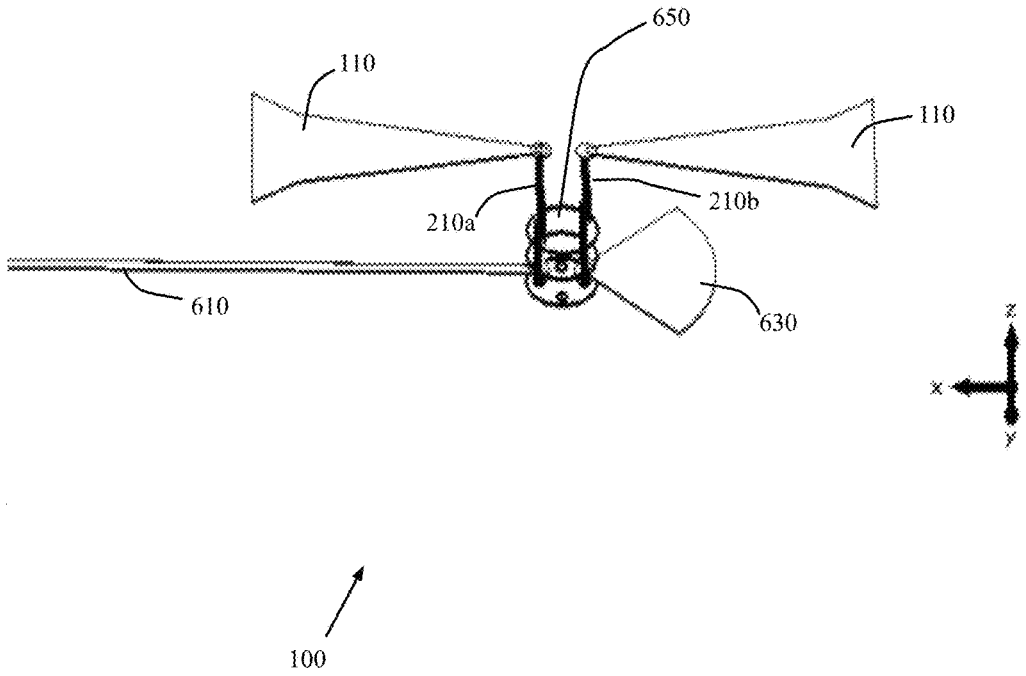
FIG. 6 illustrates an alternate perspective view of a planar antenna assembly using a single dipole with one balun according to one embodiment of the disclosure.

FIG. 6 illustrates a perspective view of planar antenna assembly 100 using a single dipole with one 3D tuning balun according to one embodiment of the disclosure. Single dipole antenna 110 is fabricated in the X-Y plane on the top layer (i.e., thin substrate layer 120) of planar antenna assembly 100. Multiple holes 650 are cut in multiple ground layers. Transmission line 610 and balun 630 are fabricated on a different layer of planar antenna assembly 100 separate from the layer on which antenna 110 is fabricated. Feed vias 210*a* and 210*b* couple antenna 110 to transmission line 610 and balun 630.

Advantageously, the designs of planar antenna assembly 100 in FIGS. 5 and 6 provides a tuning balun that is displaced in the Z-direction with respect to the X-Y plane on which the single dipole or pair of dipole antennas are fabricated. This allows for a smaller X-Y circuit footprint and accommodates tightly integrated RF designs.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An antenna assembly comprising:

a first substrate layer having a first surface;

a first antenna disposed in an X-Y plane on the first surface of the first substrate layer;

a second substrate layer having a first surface oriented parallel to the first surface of the first substrate layer, the second substrate layer displaced in the Z-direction with respect to the X-Y plane on the first surface of the first substrate layer; and a first tuning balun disposed in a plane on the first surface of the second substrate layer and coupled to the first antenna by means of a first feed via, the plane of the first tuning balun oriented parallel to the X-Y plane of the first antenna.

2. The antenna assembly as set forth in claim 1, further comprising a first transmission line disposed on the first surface of the second substrate layer.

3. The antenna assembly as set forth in claim 2, wherein the first transmission line is coupled to the first antenna by means of a second feed via.

4. An antenna assembly comprising:

a first substrate layer having a first surface;

a first antenna disposed in an X-Y plane on the first surface of the first substrate layer;

a second substrate layer having a first surface, the second substrate layer displaced in the Z-direction with respect to the X-Y plane on the first surface of the first substrate layer;

a first tuning balun disposed on the first surface of the second substrate layer and coupled to the first antenna by means of a first feed via;

a first transmission line disposed on the first surface of the second substrate layer, the first transmission line coupled to the first antenna by means of a second feed via;

a second antenna disposed in the X-Y plane on the first surface of the first substrate layer;

a third substrate layer having a first surface, the third substrate layer displaced in the Z-direction with respect to the X-Y plane on the first surface of the first substrate layer; and a second tuning balun disposed on the first surface of the third substrate layer and coupled to the second antenna by means of a third feed via.

5. The antenna assembly as set forth in claim 4, further comprising a second transmission line disposed on the first surface of the third substrate layer.

6. The antenna assembly as set forth in claim 5, wherein the second transmission line is coupled to the second antenna by means of a fourth feed via.

7. The antenna assembly as set forth in claim 6, wherein the first antenna comprises a first dipole antenna.

8. The antenna assembly as set forth in claim 7, wherein the second antenna comprises a second dipole antenna.

9. The antenna assembly as set forth in claim 8, wherein the first and second antennas comprise a crossed bowtie antenna configuration.

10. The antenna assembly as set forth in claim 9, further comprising a transceiver circuit disposed on a surface of the antenna assembly opposite the first substrate layer, wherein the transceiver circuit provides an output signal to be transmitted by the first and second antennas.

11. An antenna system comprising:

a plurality of antenna assemblies configured in a tile architecture, each of the plurality of antenna assemblies comprising:

a first substrate layer having a first surface;

a first antenna disposed in an X-Y plane on the first surface of the first substrate layer;

a second substrate layer having a first surface oriented parallel to the first surface of the first substrate layer, the second substrate layer displaced in the Z-direction with respect to the X-Y plane on the first surface of the first substrate layer; and a first tuning balun disposed in a plane on the first surface of the second substrate layer and coupled to the first antenna by means of a first feed via, the plane of the first tuning balun oriented parallel to the X-Y plane of the first antenna.

12. The antenna system as set forth in claim 11, further comprising a first transmission line disposed on the first surface of the second substrate layer.

13. The antenna system as set forth in claim 12, wherein the first transmission line is coupled to the first antenna by means of a second feed via.

14. An antenna system comprising:

a plurality of antenna assemblies configured in a tile architecture, each of the plurality of antenna assemblies comprising:

a first substrate layer having a first surface;

a first antenna disposed in an X-Y plane on the first surface of the first substrate layer;

a second substrate layer having a first surface, the second substrate layer displaced in the Z-direction with respect to the X-Y plane on the first surface of the first substrate layer; and a first tuning balun disposed on the first surface of the second substrate layer and coupled to the first antenna by means of a first feed via;

a first transmission line disposed on the first surface of the second substrate layer, the first transmission line coupled to the first antenna by means of a second feed via;

a second antenna disposed in the X-Y plane on the first surface of the first substrate layer;

a third substrate layer having a first surface, the third substrate layer displaced in the Z-direction with respect to the X-Y plane on the first surface of the first substrate layer; and a second tuning balun disposed on the first surface of the third substrate layer and coupled to the second antenna by means of a third feed via.

15. The antenna system as set forth in claim 14, further comprising a second transmission line disposed on the first surface of the third substrate layer.

16. The antenna system as set forth in claim 15, wherein the second transmission line is coupled to the second antenna by means of a fourth feed via.

17. The antenna system as set forth in claim 16, wherein the first antenna comprises a first dipole antenna.

18. The antenna system as set forth in claim 17, wherein the second antenna comprises a second dipole antenna.

19. The antenna system as set forth in claim 18, wherein the first and second antennas comprise a crossed bowtie antenna configuration.

20. The antenna system as set forth in claim 19, further comprising a transceiver circuit disposed on a surface of the antenna assembly opposite the first substrate layer, wherein the transceiver circuit provides an output signal to be transmitted by the first and second antennas.

* * * * *